US006322688B1

(12) United States Patent
Yamazaki et al.

(10) Patent No.: US 6,322,688 B1
(45) Date of Patent: Nov. 27, 2001

(54) METHOD OF FORMING AN INSULATING FILM ON A MAGNETIC STEEL SHEET

(75) Inventors: Shuichi Yamazaki; Masao Kurosaki, both of Futtsu; Kenichi Murakami, Kitakyushu; Yoshiyuki Ushigami, Futtsu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/319,209

(22) PCT Filed: Oct. 14, 1998

(86) PCT No.: PCT/JP98/04646

§ 371 Date: Jun. 1, 1999

§ 102(e) Date: Jun. 1, 1999

(87) PCT Pub. No.: WO99/19538

PCT Pub. Date: Apr. 22, 1999

(30) Foreign Application Priority Data

Oct. 14, 1997 (JP) ..... 9-280433

(51) Int. Cl.[7] ..... C25D 9/00
(52) U.S. Cl. ..... 205/320
(58) Field of Search ..... 205/320

(56) References Cited

U.S. PATENT DOCUMENTS 4,042,425 * 8/1977 Ohashi et al. ..... 148/13.1
4,846,939 * 7/1989 Yoshida et al. ..... 204/15
4,904,314 * 2/1990 Ames et al. ..... 148/113
4,964,922 * 10/1990 Ames et al. ..... 148/111
5,013,373 * 5/1991 Block ..... 148/113
5,125,991 * 6/1992 Ishitobi et al. ..... 148/308
5,782,998 * 7/1998 Ushigami et al. ..... 148/113
5,961,744 * 10/1999 Yamazaki et al. ..... 148/113
6,149,794 * 11/2000 Heimann et al. ..... 205/316

FOREIGN PATENT DOCUMENTS 3-243795 10/1991 (JP) .
40-3243795A * 10/1991 (JP) .
4-308098 10/1992 (JP) .
5-279747 10/1993 (JP) .
6-065754 3/1994 (JP) .
6-184762 7/1994 (JP) .
9-078252 3/1997 (JP) .

* cited by examiner

*Primary Examiner*—Kathryn Gorgos
*Assistant Examiner*—Erica Smith-Hicks
(74) *Attorney, Agent, or Firm*—Kenyon & Kenyon

(57) ABSTRACT

In order to improve the adhesion property of an electrical steel sheet with no film of inorganic mineral matter on its surface, especially with respect to a tension-imparting insulating film, anodic electrolysis in an aqueous solution of silicate is carried out before insulating film formation to form a silicic film excellent in adhesion property with respect to the insulating film in a thin and strongly attached condition on the steel sheet surface. By this, a tension-imparting insulating film can be formed on a grain-oriented electrical steel sheet with excellent adhesion property to reduce the iron loss of the oriented electrical steel sheet. Also in the case of an insulating film that is not of the tension-imparting type, enhancement of film heat resistance and improvement of insulating property by increasing a film thickness are possible.

16 Claims, 3 Drawing Sheets

Fig.3

ADHESION PROPERTY OF INSULATION FILM

○ NO PEELING
△ PARTIAL PEELING
× MOST PEELED

| TREATMENT SOLUTION | TREATMENT METHOD | INSULATION FILM | 0.1 | 1 | 10 | 100 |
|---|---|---|---|---|---|---|
| SODIUM SILICATE | ANODIC ELECTRO-LYSIS | COLLOIDAL SILICA + ALUMINUM PHOSPHATE | × × △ ○ ○ | | ○ | ○ |
| | | BORIC ACID + ALUMINA SOL | × × △ ○ | | ○ | ○ |
| SODIUM SILICATE | COATING AND DRYING | COLLOIDAL SILICA + ALUMINUM PHOSPHATE | | × | × | × |
| | | BORIC ACID + ALUMINA SOL | | × | × | |
| COLLOIDAL SILICA | COATING AND DRYING | COLLOIDAL SILICA + ALUMINUM PHOSPHATE | | × | × | × |
| | | BORIC ACID + ALUMINA SOL | | | | |

$SiO_2$ DEPOSITION QUANTITY/$mg \cdot m^2$

METHOD OF FORMING AN INSULATING FILM ON A MAGNETIC STEEL SHEET

TECHNICAL FIELD

The present invention provides a method of forming a film, excellent in an insulating property and a tension-imparting property, on the surfaces of an electrical steel sheet, particularly on the surfaces of a grain-oriented electrical steel sheet having no film of forsterite or other such inorganic mineral matter on its surfaces or of an annealed grain-oriented electrical steel sheet adjusted to or near a mirror state, or on the surfaces of a non-oriented electrical steel sheet.

BACKGROUND TECHNOLOGY

Electrical steel sheets are broadly divided into non-oriented electrical steel sheets and grain-oriented electrical steel sheets. Non-oriented electrical steel sheets are used mainly in the cores of rotating machines and the like and grain-oriented electrical steel sheets are used mainly in the cores of power transformers. Both are generally required to be materials with low iron loss in order to reduce energy loss. Owing to the need for a surface insulating film, they are made into products after being coated with an insulating coating. Since grain-oriented electrical steel sheets almost always contain Si, they are also referred to as grain-oriented silicon steel sheets.

In an grain-oriented electrical steel sheet whose crystal orientation is aligned in the rolling direction, i.e., a grain-oriented electrical steel sheet, the iron loss can be decreased by imparting tension to the steel sheet. For imparting tension to the steel sheet, it is effective to form at a high temperature a film composed of a material whose coefficient of thermal expansion is smaller than that of the steel sheet. This utilizes the thermal stress generated by the thermal expansion coefficient differential between the steel sheet and the film. On the surfaces of ordinary grain-oriented electrical steel sheet there is present a film composed mainly of forsterite formed during finish annealing (hereinafter called the "finish annealing film") by reaction between an oxide film composed mainly of $SiO_2$ produced at the decarburization annealing step and the MgO commonly used as an annealing separation agent. This finish annealing film effectively reduces iron loss by imparting a large tension to the steel sheet.

Further, JP-A-(unexamined published Japanese patent application) 48-39338 teaches an insulating film obtained by coating the surfaces of a steel sheet with a coating solution composed mainly of colloidal silica and phosphate, followed by baking. This insulating film effectively reduces iron loss by imparting a large tension. The ordinary method of producing a grain-oriented electrical steel sheet is therefore to impart an insulating film without removing the film produced in the finish annealing step.

Attempts have been made to increase the tension to the steel sheet by an insulating film. For instance, JP-A-6-306628 teaches an $Al_2O_3$—$B_2O_3$-system crystalline film obtained by baking on a coating solution composed mainly of alumina sol and boric acid, which, for the same film thickness, enables a film tension to be secured that is 1.5–2 times that secured when a coating solution composed mainly of colloidal silica and phosphate is baked on.

On the other hand, it was recently learned that a disorderly interface structure between the finish annealing film and the steel matrix to some degree cancels the effect of film tension on the iron loss.

Thus, as disclosed in JP-A-49-96920 and JP-A-4-131326, for example, technologies have been developed that attempt to further reduce iron loss by use of a mechanical method such as polishing or grinding, or of a chemical method such as pickling, to remove the finish annealing film occurring in the finish annealing step, or by preventing formation of a finish annealing film in the finish annealing, thereby achieving a state with substantially no finish annealing film or a near mirror state, and then freshly imparting a tension film.

Avoiding formation of a finish annealing film has other advantages aside from lowering iron loss. The film composed mainly of forsterite formed by finish annealing is hard and the cuttability of the steel sheet is poor. As taught by JP-A-64-62476, therefore, it has been proposed to include an additive in the annealing separation agent utilized in finish annealing so as to hinder formation of a finish annealing film and is thereafter impart an insulating film.

However, the adhesion property of the insulating film, although considerable when the insulating film is formed on a finish annealing film, is generally inferior when no finish annealing film is substantially present, such as in a case where the finish annealing film is removed or formation of a finish annealing film is deliberately avoided in the finish annealing step. In particular, tight film adhesion is not obtained at all when the insulating film has tension-imparting property. Even an insulating film without tension-imparting property will loose its tight adhesion property if applied thickly to secure high insulating property.

However, the following is possible. It is generally considered difficult to form a strong chemical bonding force between an oxide and a metal. In insulating film formation, the baking is generally conducted by continuous annealing and the annealing time has to be set on the order of several minutes in order to achieve reasonable productivity. This generally makes it difficult to obtain a chemical bonding force adequate for obtaining tight adhesion between an insulating film composed of oxide and the steel matrix. In the case of a finish annealing film, on the other hand, several tens of hours can be used for film formation because finish annealing is batch annealing. Even though the reaction that forms the bonding force between the film and the steel matrix proceeds slowly, good adhesion can be obtained in the end owing to the long annealing time. As both the finish annealing film and the insulating film are oxides, tight mutual adhesion can be easily obtained even if the insulating film formation time is short.

Therefore, when attempting to eliminate the finish annealing film and to form the insulating film directly on the steel matrix, a technology enabling tight adhesion between the insulating film and the matrix is necessary in order to reduce the iron loss value of a grain-oriented electrical steel sheet to the absolute minimum. Even when a finish annealing film is present, moreover, the adhesion of the insulating film becomes unstable when the finish annealing film is thin or the finish annealing film is absent.

Regarding this problem, the inventors of JP-A-6-184762 proposed a method for improving the adhesion property of a tension-imparting type insulating film with respect to a grain-oriented electrical steel sheet with no finish annealing film. Specifically, this is a method of forming a $SiO_2$ film having good adhesion property with the steel matrix before insulating film formation. As explicit $SiO_2$ film forming methods, JP-A-6-184762 set outs a method of forming a $SiO_2$ film by annealing in a weak reducing atmosphere to selectively oxidize Si inherently contained in a silicon steel sheet and a method that uses CVD, PVD or other dry coating. In the case of annealing in a reducing atmosphere, however, annealing equipment enabling atmosphere control is newly required, while in the case of dry coating, vacuum deposition equipment is necessary. These two methods therefore have a problem regarding processing cost.

SUMMARY OF THE INVENTION

The present invention provides a technology of low processing cost for improving the adhesion property of an insulating film to a steel sheet. Its object is to enable inexpensive industrial production of a grain-oriented electrical steel sheet with very low iron loss whose steel sheet surfaces are mirror surfaces and are provided with tension-imparting insulating film and of a non-oriented or grain-oriented electrical steel sheet of excellent machinability and with a high insulating property. Specifically, it is a method of forming an insulating coating having high film adhesion property by subjecting an electrical steel sheet to anodic electrolysis in an aqueous solution of silicate to form a film-like thin silicic film on the steel sheet surfaces and thereafter providing an insulating coating.

The first aspect of the present invention is a method of forming an insulating film on an electrical steel sheet characterized in, when forming an insulating film on an electrical steel sheet, forming a silicic film by anodic electrolysis of the steel sheet in an aqueous solution of silicate and thereafter forming an insulating film. By this method, an insulating film can be formed with good adhesion property on the surfaces of a steel sheet.

The second aspect of the present invention is a method of forming an insulating film on an electrical steel sheet according to the first aspect of the invention, characterized in that the aqueous solution of silicate is an aqueous solution having dissolved therein one or more of lithium silicate, sodium silicate, potassium silicate and ammonium silicate. By this method, the aqueous solution of silicate can be easily prepared and a silicic film can be easily formed.

The third aspect of the present invention is a method of forming an insulating film on an electrical steel sheet according to the first or second aspect of the invention, characterized in that $SiO_2$ amount in the silicic film formed on the surfaces of the steel sheet by anodic electrolysis in the aqueous solution of silicate is not less that 2 $mg/m^2$ per surface of the steel sheet. By this method, a tight adhesion property of the insulating film can be expediently secured.

The fourth aspect of the present invention is a method of forming an insulating film on an electrical steel sheet according to the first, second or third aspect of the invention, characterized in that the electrical steel sheet is a grain-oriented electrical steel sheet having substantially no finish annealing film on the steel sheet surfaces and the insulating film is of tension-imparting type. By this method, a tension-imparting insulating film can be formed with good adhesion property on a grain-oriented electrical steel sheet having mirror-finished or smoothed steel sheet surfaces.

The fifth aspect of the present invention is a method of forming an insulating film according to the fourth aspect of the invention, characterized in that a coating solution of the tension-imparting insulating film is composed mainly of colloidal silica and phosphate. By this method, a film with high tension-imparting property can be formed with good adhesion property.

The sixth aspect of the present invention is a method of forming an insulating film according to the fourth aspect of the invention, characterized in that a coating solution of the tension-imparting insulating film is composed mainly of alumina sol. By this method, an alumina insulating film with high tension-imparting property can be formed with good adhesion property.

The seventh aspect of the present invention is a method of forming an insulating film according to the fourth aspect of the invention, characterized in that a coating solution of the tension-imparting insulating film is composed mainly of alumina sol and boric acid. By this method, an $Al_2O_3$—$B_2O_3$-system crystalline insulating film with high tension-imparting property can be formed with good adhesion property.

BRIEF DESCRIPTION OF DRAWINGS

FIG. 3 is a diagram showing effect of Si deposition quantity on a direct adhesion property between tension-imparting insulating film and steel sheet in different wet silicic film formation methods.

DETAILED DESCRIPTION

In JP-A-6-184762, the inventors demonstrated that, when an insulating film is formed after forming an intermediate layer having good adhesion property with both the insulating film and the steel sheet, a high film adhesive force can be secured even in the case of a steel sheet without a finish annealing film, i.e., a steel sheet with exposed base metal, and that $SiO_2$ is effective as the intermediate layer. Thereafter, upon studying methods for forming a $SiO_2$ with good adhesion property with a steel matrix at low cost, they discovered that the silicic film obtained by anodic electrolysis in an aqueous solution of silicate is suitable.

A detailed explanation will now be made along with specific indication of the study results.

Figure 1:
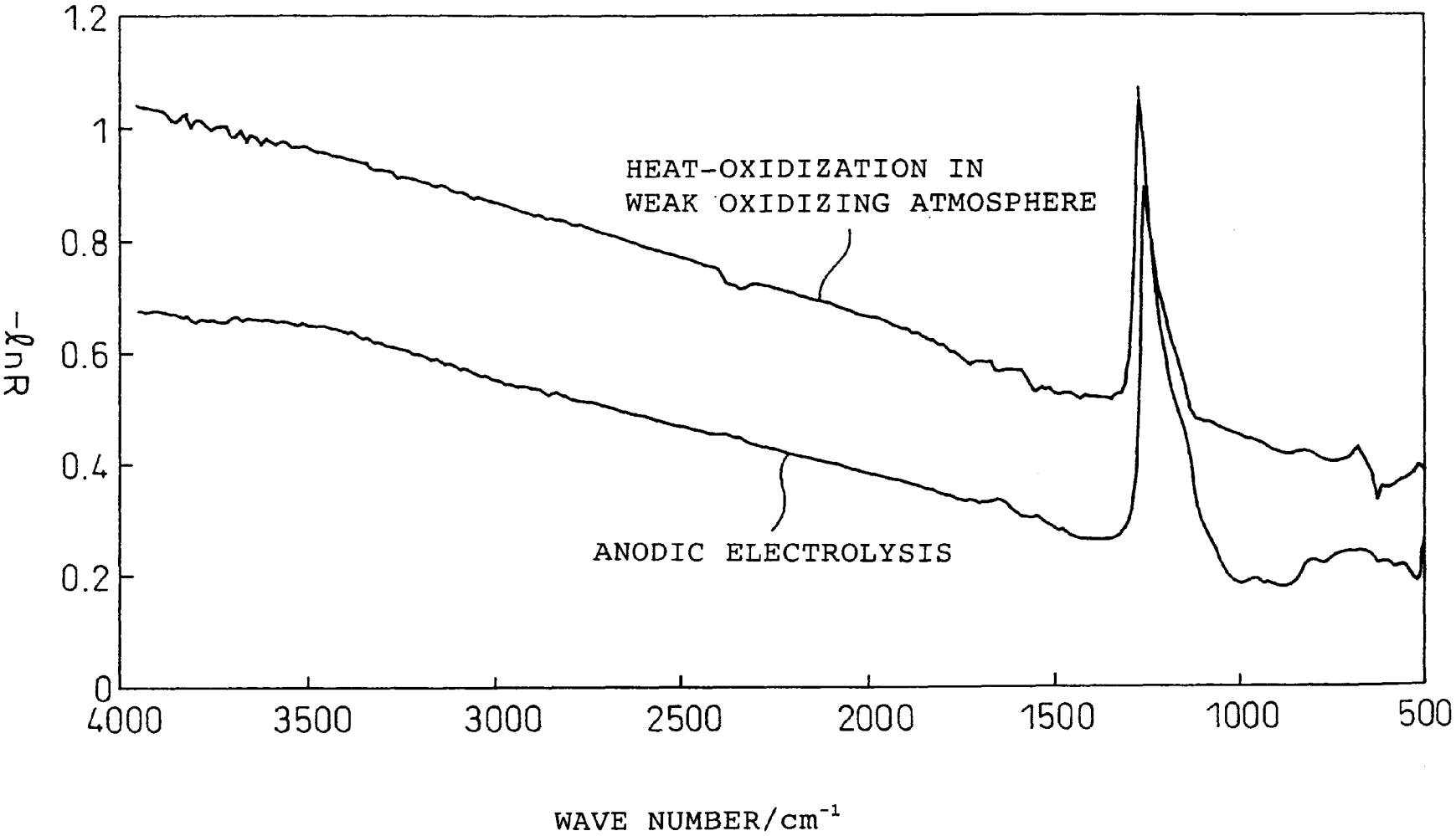
FIG. 1 is a diagram showing the infrared reflectance spectra of a silicon steel sheet annealed in a weak oxidizing atmosphere and a cold-rolled steel sheet subjected to anodic electrolysis in an aqueous solution of silicate.

First, films formed by electrolysis in aqueous solution of silicate were investigated. Infrared reflectance spectrum measurement was conducted in order to investigate the chemical properties of films produced by subjecting ordinary cold-rolled steel sheet to anodic electrolysis in No. 1 sodium silicate (mole ratio of $Na_2O$ to $SiO_2$ of 1:2). The infrared reflectance spectrum enables detection of a dielectric thin film on metal with high sensitivity, the sensitivity being especially high for silicates (Shuichi Yamazaki: *Journal of the Japan Institute of Metals,* vol.56, p.548 (1992). The incidence angle of the infrared light with respect to the normal direction of the sample was 80 degrees. FIG. 1 is one example, in which the vertical axis represents the logarithm of the reflectance. For comparison, there is also shown in FIG. 1 the infrared reflectance spectrum for a silicon steel sheet by the $SiO_2$ film forming method disclosed in JP-A-6-184762, i.e., having $SiO_2$ film formed on its surfaces by annealing in a weak oxidizing atmosphere. In this figure, the two spectra agree very well. It was thus found that the $SiO_2$ films obtained by anodic electrolysis in aqueous solution of silicate and by annealing a silicon steel sheet in a weak oxidizing atmosphere are substantially identical films.

Figure 2:
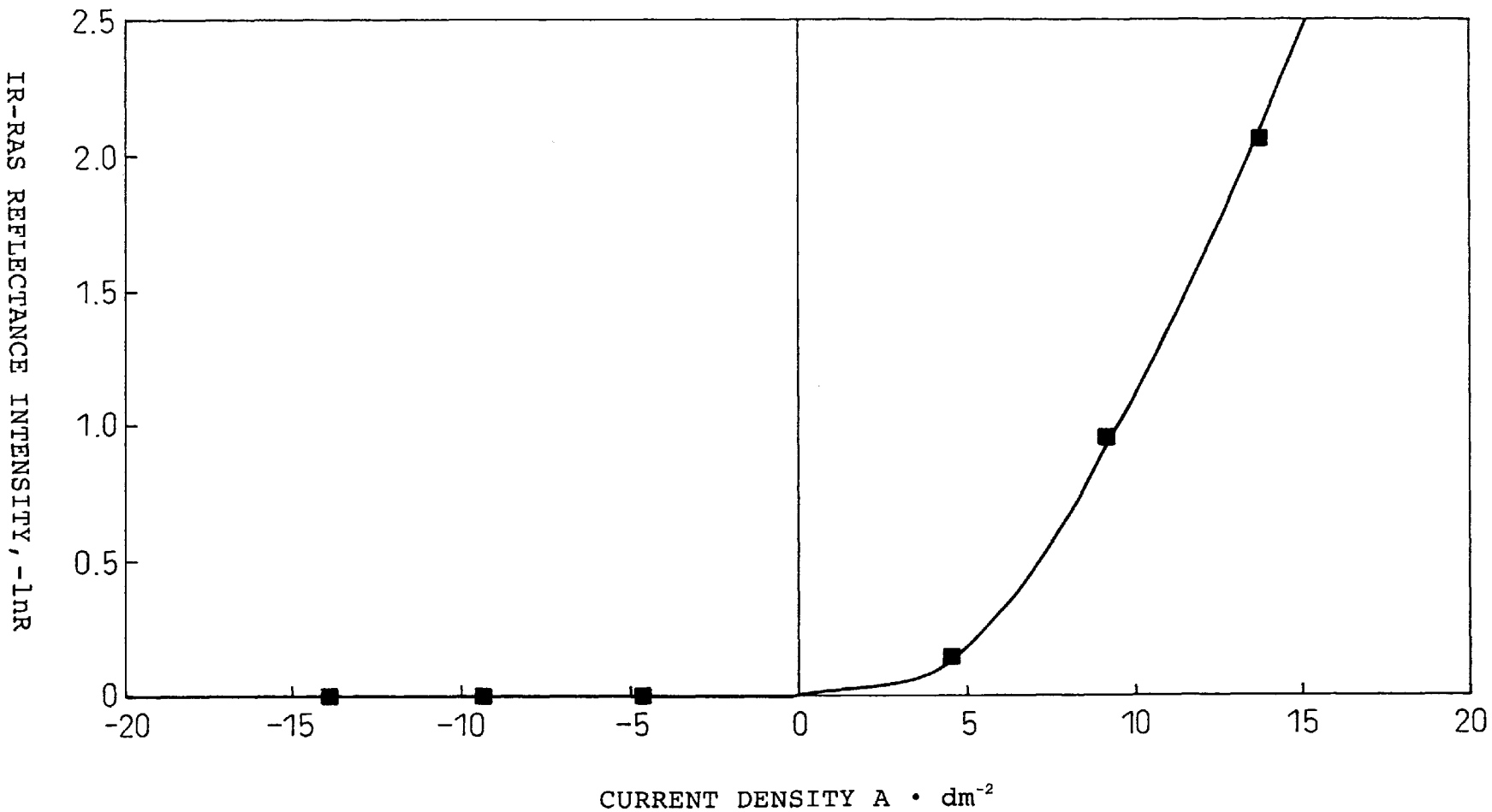
FIG. 2 is a diagram showing the polarity and current density dependence of amount of $SiO_2$ produced by anodic electrolysis in aqueous solution of silicate.

Next, the electrolysis conditions for obtaining such film were investigated. Silicic film formation was tested by conducting electrolysis on ordinary cold-rolled steel sheets in aqueous solution of sodium silicate under various electrolysis conditions. FIG. 2 is an example of the experimental results, showing the electrolysis polarity and current density dependence of the amount of silicic film formed on the steel sheet. The amount of silicic film formed was estimated semi-quantitatively from the infrared reflectance spectrum intensity. Specifically, use was made of the fact that $-\ln(R/Rb)$ calculated from the peak reflectance R in the vicinity of 1250 $cm^{-1}$ where $SiO_2$ is determined and the background reflectance Rb is proportional to the amount of $SiO_2$. It can be seen from FIG. 2 that, in the case of electrolysis in aqueous solution of silicate, formation of $SiO_2$ does not occur when the steel sheet is made the cathode and is limited to anodic electrolysis. Moreover, it can be seen that, on the anode side, the amount of $SiO_2$ increases with increasing current density. Successive experiments were conducted using various silicates at different concentrations and temperatures, but the foregoing tendency was always present. That is, formation of $SiO_2$ did not occur in cathodic electrolysis even if the current density was increased and, in anodic electrolysis, the amount of $SiO_2$ increased with increasing current density.

Further, $SiO_2$ films formed by the aforesaid anodic electrolysis in aqueous solution of silicate were evaluated for adhesion property with respect to insulating films. Commercially available grain-oriented electrical steel sheet containing 3% silicon (Si) was removed of finish annealing film by the method described in JP-A-4-131326, i.e., by pickling, and steel sheet having no finish annealing film and a mirror surface condition was thereafter obtained by a method of high-temperature, long-period annealing in a reducing atmosphere using electrical steel sheet having a finish annealing film as a spacer. Silicic film formation was tested by subjecting this steel sheet to anodic electrolysis under various electrolysis conditions. The amount of silicic film formed was determined from the infrared reflectance spectrum intensity. For comparison, treatment was also conducted for depositing silicic films by simple coating and drying of aqueous solution of sodium silicate and colloidal silica.

Next, tension-imparting insulating film were formed on these steel sheets and the adhesion to the insulating film was evaluated. Specifically, evaluation was made regarding the vitreous film disclosed in JP-A-48-39338 obtained by baking a coating solution composed mainly of colloidal silica and phosphate and the $Al_2O_3$—$B_2O_3$-system crystalline film disclosed in JP-A-6-306628 obtained by baking a coating solution composed mainly of alumina sol and boric acid. In both cases, the amount thereof formed was 5 $g/m^2$ (per surface). The tension imparted to the steel sheets obtained by forming these films could be calculated from the steel sheet warp occurring when one surface was protected and the film was removed from only one side by immersing the steel sheet in a hot aqueous alkali solution. The film tension imparted to the steel sheet was 0.7 $kgf/mm^2$ in the case of the former insulating film and was 1.4 $kgf/mm^2$ in the case of the latter. The film adhesion was evaluated by whether or not the film peeled when the steel sheet was wrapped around a 20 mm diameter round rod.

In FIG. 3, the test results are tabulated by silicic film formation method, formed amount of silicic film and type of insulating film, in relation to the insulating film adhesion property. When anodic electrolysis in aqueous solution of sodium silicate was carried out, satisfactory adhesion property was obtained with respect to all of the tension-imparting insulating films insofar as 2 $mg/m^2$ or more of silicic film was formed.

On the other hand, in the cases where a silicic film was formed by coating and drying aqueous solution of sodium silicate or colloidal silica, no adhesion property was obtained whatsoever even when the silicic film deposition quantity was considerable. It therefore can be said that, in order to improve the adhesion property with respect to a tension-imparting insulating film, a silicic film obtained simply by coating and drying is not necessary but a silicic film or a $SiO_2$ film obtained by anodic electrolysis is necessary. The reason for the poor insulating film adhesion property in the case of applying a silicic film by simple coating and drying is presumed to be that the adhesion property of the silicic film itself with respect to the steel sheet is poor. In other words, the silicic film or $SiO_2$ film formed by anodic electrolysis is thought to stick to the steel sheet surface with extremely good adhesion property despite its thinness. No published literature exists which reports that a silicic film formed by electrolysis, particularly by anodic electrolysis in an aqueous solution of silicate, strongly attaches to an electrical steel sheet in this way. This first became known by the present invention.

No adverse effect of the anodic electrolysis on the iron loss value was observed whatsoever. In the Examples set out later it is rather shown that the smooth-surfaced grain-oriented electrical steel sheet applied with the tension-imparting insulating film by such treatment exhibited an extremely low iron loss value in combination with so-called magnetic domain control processing, such as the laser radiation treatment or plasma radiation taught by, among others, JP-A-57-2252 and JP-A-59-255928, the groove formation on the steel sheet surface by a gear roll taught by, among others, JP-A-61-117218, the groove formation by etching taught by, among others, JP-B-(examined published Japanese patent application) 3-69968 and the groove formation by laser radiation taught by, among others, JP-A-61-75506.

The present invention will next be described in detail with reference to embodiments.

In the case where it is desired to form an insulating film on the surface of an electrical steel sheet, the present invention utilizes anodic electrolysis in an aqueous solution of silicate to form, between the steel sheet surface and the insulating film, an intermediate layer with good adhesion property with respect to both and, by this formation of the intermediate layer, establishes strong adhesion between the insulating film and the steel sheet surface. It is therefore suitable not only in a case where such an intermediate layer (finish annealing film in the case of a grain-oriented electrical steel sheet) has not been formed but also in a case where an intermediate layer is present but insulating film adhesion property cannot be reliably secured because the intermediate layer is, for example, unevenly formed or too thin.

Therefore, it is, for example, suitable for a grain-oriented electrical steel sheet which, for a purpose as such as cuttability improvement, was deprived of its finish annealing film by conducting pickling after finish annealing or was subjected to suppression of finish annealing film formation by including an additive in the annealing separation agent during finish annealing. It is also suitable for a grain-oriented electrical steel sheet which, in order to obtain an electrical steel sheet with low iron loss, was deprived of its finish annealing film and thereafter surface-smoothed by chemical or mechanical polishing or by high-temperature annealing in a reducing atmosphere or other such means, or was surface-smoothed by, at the time of finish annealing, removing the oxide film formed during primary recrystallization annealing and selecting an annealing separation agent other than MgO, or was surface-smoothed by effecting finish annealing using as the annealing separation agent an alkali metal containing alumina or the like.

When the method of the present invention is applied to an electrical steel sheet on which a finish annealing film is generally present but was, for some reason, suppressed in formation amount or locally not formed, the adhesion property of the insulating film and the steel sheet can be stabilized.

Application with respect to a non-oriented electrical steel sheet having no finish annealing film from the start is also possible and enables improvement of the insulating film adhesion property and is also suitable for enhancing insulating property by thick coating.

Any silicate that is water soluble can be used. Alkali metal silicates and ammonium silicate can therefore be used. Among these, sodium silicate, called waterglass, is inexpensive and readily available. Use of a mixture of multiple silicates does not impair the effect of present invention. A concentration of silicate with respect to water of around 0.1–30% by weight facilitates use. This is because at less than 0.1% the solution concentration tends to fall with deposition of $SiO_2$ on the steel sheet, making electrolyte control difficult. At greater than 30%, the electrolyte becomes hard to handle owing to its high viscosity.

In the present invention, the polarity of the steel sheet during electrolysis is set to anodic. On the other hand, there are in general no restrictions regarding silicate concentration and temperature, the current density and the electrolysis time period. It suffices to select the type and concentration of the silicate, the current density and the electrolysis time period so as to secure an amount of formed silicic film of 2 $mg/m^2$ in terms of Si weight per surface of the steel sheet.

As shown in FIG. 2, the $SiO_2$ deposition rate increases exponentially with increasing current density. Although $SiO_2$ deposition rate varies with silicate concentration and temperature even if the current density is made constant, the $SiO_2$ deposition rate is generally extremely slow at less than 2 $A/dm^2$. On the other hand, if a high current density is set, the desired amount of $SiO_2$ deposition can be obtained in a very short time, but heat generation during electrolysis increases and a large electrolysis power source is necessary. Not higher than 50 $A/dm^2$ is therefore preferable. The preferable current density range is therefore 2–50 $A/dm^2$. Assuming continuous line processing, the electrolysis time period is preferably not greater than 1 min from the viewpoint of processing cost. An infinite number of sets of electrolysis conditions enabling formation of not less than 2 $mg/m^2$ of $SiO_2$, the amount required to impart adhesion property to the insulating film, are available by combining silicate concentration, solution temperature and current density. Although there is no upper limit on the amount of $SiO_2$ deposition from the viewpoint of the technical effect of the invention, an amount of $SiO_2$ deposition on the steel sheet of not greater 1 $g/m^2$ is preferable from the aspect of processing cost.

As the insulating film there can be adopted a heat-resistant inorganic insulating film ordinarily adopted for grain-oriented electrical steel sheet. In particular, the present invention manifests optimum effect when the insulating film is of tension-imparting type. Specific ones that can be mentioned are the insulating film of JP-A-48-39338 obtained by coating and baking a coating solution composed mainly of colloidal silica and phosphate and the $Al_2O_3$—$B_2O_3$-system crystalline film of JP-A-6-306628 obtained by coating and baking a coating solution composed mainly of alumina sol and boric acid. Various tensioning film materials are also taught by JP-A-6-248465, including an a-alumina film that can be obtained by coating and baking alumina sol. The present invention is thus effective when an insulating film, particularly a tension-imparting insulating film is baked with good adhesion property on a grain-oriented electrical steel sheet whose steel sheet is exposed without a finish annealing film. The range of application of the present invention is, however, not limited to tension-imparting insulating films. It also has the effect of markedly improving the adhesion property of an insulating film with weak or absolutely no tension-imparting property. Specifically, as shown by the Examples, the insulating film adhesion after stress relieving annealing is improved and improvement of insulating property by film thickening is facilitated. Therefore, it is possible to improve the adhesion property of not only the insulating film of a grain-oriented electrical steel sheet but also the insulating film of a non-oriented electrical steel sheet.

EXAMPLES

Examples will next be explained.

Example 1

A silicon steel containing 3% of Si and rolled to a final thickness of 0.23 mm was decarburization annealed to be simultaneously formed with an oxide layer containing $SiO_2$ on the electrical steel surface and was then coated with an annealing separation agent composed mainly of MgO and subjected to final finish annealing. Since a film composed mainly of forsterite was present on the surface of the grain-oriented electrical steel sheet annealed in this manner, the forsterite film was removed by immersing the steel sheet in a sulfuric-hydrofluoric acid solution (sheet thickness: 0.22 mm). The surface was then given a mirror finish by conducting high-temperature, long-period annealing in a reducing atmosphere using an electrical steel sheet having a finish annealing film as a spacer. Anodic electrolysis in a 2% aqueous solution of no. 1 sodium silicate was further conducted. The electrolysis was conducted in the 2% No. 1 sodium silicate (mole ratio of $Na_2O$ to $SiO_2$ of 1:2) under conditions of a current density of 5 $A/dm^2$ and an electrolysis period of 15 sec. Next, a treatment solution composed of colloidal silica, aluminum phosphate and anhydrous chromic acid was applied and baked at 850° C. to form a tension-imparting insulating film (according to JP-A-48-39338) (amount of formed insulating film: 5 $g/m^2$ per surface).

As a comparative example, tension-imparting insulating film baking treatment was conducted under the same conditions with respect to a steel sheet not subjected to the electrolysis.

The insulating film adhesion of the grain-oriented electrical steel sheet with tension-imparting insulating film produced in this manner and its magnetic properties after laser radiation (B8: magnetic flux density at 800 A/m, W17/50: iron loss at 1.7T, 50 Hz) are shown in Table 1 along with those of the non-electrolyzed comparative example. When anodic electrolysis was carried out on a finish-annealed grain-oriented electrical steel sheet exhibiting mirror surfaces, the adhesion of the tension-imparting insulating film was excellent and a grain-oriented electrical steel sheet with extremely low iron loss was obtained.

TABLE 1

| Anodic electro-lysis | $SiO_2$ deposition quantity ($mg/m^2$) | B8 (T) | W17/50 (W/kg) | Insulation film adhesion | |
|---|---|---|---|---|---|
| Yes | 5 | 1.93 | 0.65 | No peeling | Invention |
| No | 0 | 1.94 | 0.75 | Almost completely peeled | Comparative |

Example 2

An electrical steel containing 3% of Si and rolled to a final thickness of 0.23 mm was decarburization annealed and the oxide layer containing $SiO_2$ formed at this time was removed by pickling, whereafter an annealing separation agent composed mainly of alumina was applied and final finish annealing was conducted. The grain-oriented electrical steel sheet annealed in this manner exhibited mirror surfaces with no finish annealing film present thereon. Using a gear roll, this steel sheet was formed in the direction perpendicular to the rolling direction with 10 $\mu$m-deep, 100 $\mu$-wide grooves spaced at intervals of 5 mm. Anodic electrolysis was then conducted in a 2% aqueous solution of potassium silicate. The electrolysis was then conducted in the 2% potassium silicate (mole ratio of $K_2O_3$ to $SiO_2$ of 1:3) under conditions of a current density of 8 $A/dm^2$ and an electrolysis period of 15 sec. Next, a treatment solution composed mainly of boric acid and alumna sol was applied and baked at 850° C. to form a tension-imparting insulating film (according to JP-A-6-306628) (amount of formed insulating film: 5 $g/m^2$ per surface).

As a comparative example, tension-imparting insulating film baking treatment was conducted under the same conditions with respect to a steel sheet not subjected to the electrolysis.

The insulating film adhesion and magnetic properties of the grain-oriented electrical steel sheet with tension-imparting insulating film produced in this manner and formed with grooves are shown in Table 2 along with those of the non-electrolyzed comparative example. When anodic electrolysis was carried out on a finish-annealed grain-oriented electrical steel sheet exhibiting mirror surfaces, the adhesion of the tension-imparting insulating film was excellent and a grain-oriented electrical steel sheet with extremely low iron loss was obtained.

TABLE 2

| Anodic electro-lysis | $SiO_2$ deposition quantity ($mg/m^2$) | B8 (T) | W17/50 (W/kg) | Insulation film adhesion | |
|---|---|---|---|---|---|
| Yes | 4 | 1.91 | 0.65 | No peeling | Invention |
| No | 0 | 1.92 | 0.85 | Almost completely peeled | Comparative |

Example 3

An electrical steel containing 3% of Si and rolled to a final thickness of 0.23 mm was decarburization annealed, coated with an annealing separation agent composed mainly of alumina containing 0.3% of $Na_2O$, and final finish annealed. The grain-oriented electrical steel sheet annealed in this manner exhibited a mirror surface condition with no annealing formed film. Using a gear roll, this steel sheet was formed in the direction perpendicular to the rolling direction with 10 $\mu$m- deep, 100 $\mu$m-wide groove spaced at intervals of 5 mm. Anodic electrolysis was then conducted in a 2% aqueous solution of lithium silicate. The electrolysis was conducted in the 2% lithium silicate (mole ratio of $Li_2O$ to $SiO_2$ Of 1:2) under conditions of a current density of 14 $A/dm^2$ and an electrolysis period of 5 sec. Next, a treatment solution prepared by adding 20 wt% of $\alpha$-alumina powder of 0.2 $\mu$m mean particle size to ground alumina sol was applied and baked at 850° C. to form a tension-imparting insulating film (according to Japanese Patent Application No. 9-291117) (amount of formed insulating film: 5 $g/m^2$ per surface). As a comparative example, tension-imparting insulating film baking treatment was conducted under the same conditions with respect to a steel sheet not subjected to the electrolysis.

The insulating film adhesion and magnetic properties of the grain-oriented electrical steel sheet with tension-imparting insulating film produced in this manner and formed with grooves are shown in Table 3 along with those of the non-electrolyzed comparative example. When anodic electrolysis was carried out on a finish-annealed grain-oriented electrical steel sheet exhibiting mirror surfaces, the adhesion of the tension-imparting insulating film was excellent and a grain-oriented electrical steel sheet with extremely low iron loss was obtained.

TABLE 3

| Anodic electro-lysis | $SiO_2$ deposition quantity ($mg/m^2$) | B8 (T) | W17/50 (W/kg) | Insulation film adhesion | |
|---|---|---|---|---|---|
| Yes | 3 | 1.91 | 0.65 | No peeling | Invention |
| No | 0 | 1.92 | 0.85 | Almost completely peeled | Comparative |

Example 4

An electrical steel containing 3% of Si and rolled to a final thickness of 0.30 mm was decarburization annealed to be simultaneously formed with an oxide layer containing $SiO_2$ on the electrical steel surface and was then coated with an annealing separation agent composed mainly of MgO containing 5% of $CaCl_2$ and subjected to final finish annealing. No film composed mainly of forsterite was formed on the surface of the grain-oriented electrical steel sheet annealed in this manner. Anodic electrolysis in a 3% aqueous solution of sodium silicate was conducted on this steel sheet. The electrolysis was conducted in 3% no. 1 sodium silicate (mole ratio of $Na_2O$ to $SiO_2$ of 1:2) under conditions of a current density of 4 $A/dm^2$ and an electrolysis period of 20 sec. Next, a treatment solution composed mainly of magnesium phosphate and chromic acid (aqueous solution prepared at a weight ratio of magnesium phosphate to anhydrous chromic acid of 5:1) was applied at varying coating weights and baked at 500° C. to form tension-imparting insulating films. The films imparted almost no tension to the steel sheet but electrical steel sheets highly excellent in cuttability were obtained.

As a comparative examples, insulating film baking treatment was conducted under the same conditions with respect to steel sheet not subjected to the electrolysis.

The insulating film adhesion and insulation breakdown voltages of the grain-oriented electrical steel sheets with insulating films produced in this manner and strain relieving annealed for 2 hr at 800° C. are shown in Table 4 along with those of the non-electrolyzed comparative examples. When anodic electrolysis was carried out, the adhesion of the insulating film after stress relieving annealing increased, ensuring adhesion property after stress relieving annealing even at thick film formation and providing a grain-oriented electrical steel sheet with a high insulation breakdown voltage.

TABLE 4

| Anodic electro-lysis | $SiO_2$ deposition quantity ($mg/m^2$) | Amount of insulation film ($g/m^2$) | Insulation break-down voltage (V) | Insulation film adhesion | |
|---|---|---|---|---|---|
| Yes | 4 | 2 | 105 | No peeling | Invention |
| | 4 | 4 | 147 | No peeling | |
| | 4 | 6 | 172 | No peeling | |
| No | 0 | 1 | 54 | Almost completely peeled | Comparative |
| | 0 | 2 | 0 | | |

Example 5

Anodic electrolysis in a 4% aqueous solution of no. 3 sodium silicate was conducted on a non-oriented electrical steel rolled to a final thickness of 0.50 mm. The electrolysis was conducted in 4% no. 3 sodium silicate (mole ratio of $Na_2O$ to $SiO_2$ of 1:3) under conditions of a current density of 9 $A/dm^2$ and an electrolysis period of 20 sec. Next, a treatment solution composed mainly of magnesium phosphate and chromic acid (aqueous solution prepared at a weight ratio of magnesium phosphate to anhydrous chromic acid of 5:1) was applied at varying coating weights and baked at 500° C. As comparative examples, insulating film baking treatment was conducted under the same conditions with respect to steel sheet not subjected to the electrolysis.

The insulating film adhesion and interlayer resistances of the non-oriented electrical steel sheets with insulating films produced in this manner and strain relieving annealed for 2 hr at 800° C. are shown in Table 5 along with those of the non-electrolyzed comparative examples. When anodic electrolysis was carried out, the adhesion of the insulating film increased, enabling thick film formation and providing a non-oriented electrical steel sheet with excellent interlayer resistance.

TABLE 5

| Anodic electro-lysis | $SiO_2$ deposition quantity ($mg/m^2$) | Amount of insulation film ($g/m^2$) | Insterlayer resistance ($\Omega \cdot m^2$/sheet) | Insulation film adhesion | |
|---|---|---|---|---|---|
| Yes | 6 | 2 | 42 | No peeling | Invention |
| | 6 | 4 | 83 | No peeling | |
| | 6 | 6 | 128 | No peeling | |
| No | 0 | 1 | 20 | Almost completely peeled | Comparative |
| | 0 | 2 | 0 | | |

Industrial Applicability

As explained in the foregoing, the present invention provides a method for improving the direct adhesion property between an electrical steel sheet and an insulating film. The method of forming an insulating film according to the present invention therefore enables production of grain-oriented electrical steel sheet with excellent flatness of the film-steel matrix interface, strong tension imparted to the steel sheet and low iron loss, and non-oriented electrical steel sheet or grain-oriented electrical steel sheet excellent in insulation breakdown voltage or interlayer resistance, and, as such, has great industrial effect.

What is claimed is:

1. A method of forming an insulating film on an electrical steel sheet comprising the steps of, when forming the insulating film on the electrical steel sheet with no finish annealing film present on part or all of the steel sheet surface, depositing a silicic film by anodic electrolysis of the steel sheet in an aqueous solution of silicate and thereafter forming the insulating film.

2. The method of forming an insulating film on an electrical steel sheet according to claim 1, wherein the aqueous solution of silicate is an aqueous solution having dissolved therein at least one or more of lithium silicate, sodium silicate, potassium silicate and ammonium silicate.

3. The method of forming an insulating film on an electrical steel sheet according to claim 1 wherein an amount of silicic film is formed on surfaces of the steel sheet by anodic electrolysis in the aqueous solution of silicate in not less than 2 $mg/m^2$, as $SiO_2$ weight, per surface of the steel sheet.

4. The method of forming an insulating film on an electrical steel sheet according to claim 1, wherein the electrical steel sheet is a grain-oriented electrical steel sheet having no finish annealing film on part or all of a steel sheet surface and the insulating film is tension-imparting.

5. The method of forming an insulating film according to claim 4, wherein a coating solution of the tension-imparting insulating film is composed mainly of colloidal silica and phosphate.

6. The method of forming an insulating film according to claim 4, wherein a coating solution of the tension-imparting insulating film is composed mainly of alumina sol.

7. The method of forming an insulating film according to claim 4, wherein a coating solution of the tension-imparting insulating film is composed mainly of alumina sol and boric acid.

8. The method of forming an insulating film on an electrical steel sheet according to claim 2, wherein an amount of silicic film is formed on surfaces of the steel sheet by anodic electrolysis in the aqueous solution of silicate in not less than 2 $mg/m^2$, as $SiO_2$ weight, per surface of the steel sheet.

9. The method of forming an insulating film on an electrical steel sheet according to claim 2, wherein the electrical steel sheet is a grain-oriented electrical steel sheet having no finish annealing film on part or all of a steel sheet surface and the insulating film is tension-imparting.

10. The method of forming an insulating film on an electrical steel sheet according to claim 3, wherein the electrical steel sheet is a grain-oriented electrical steel sheet having no finish annealing film on part or all of a steel sheet surface and the insulating film is tension-imparting.

11. The method of forming an insulating film according to claim 9, wherein a coating solution of the tension-imparting insulating film is composed mainly of colloidal silica and phosphate.

12. The method of forming an insulating film according to claim 10, wherein a coating solution of the tension-imparting insulating film is composed mainly of colloidal silica and phosphate.

13. The method of forming an insulating film according to claim 9, wherein a coating solution of the tension-imparting insulating film is composed mainly of alumina sol.

14. The method of forming an insulating film according to claim 10, wherein a coating solution of the tension-imparting insulating film is composed mainly of alumina sol.

15. The method of forming an insulating film according to claim 9, wherein a coating solution of the tension-imparting insulating film is composed mainly of alumina sol and boric acid.

16. The method of forming an insulating film according to claim 10, wherein a coating solution of the tension-imparting insulating film is composed mainly of alumina sol and boric acid.

* * * * *